US005468209A

United States Patent [19]

Rohrhiursch et al.

[11] Patent Number: 5,468,209

[45] Date of Patent: Nov. 21, 1995

[54] SEALING FOR A FOLDIN BALDE SHAFT

[75] Inventors: Ulrich Rohrhiursch, Unterroth; Georg Schmid, Gablingen, both of Germany

[73] Assignee: MAN Roland Druckmaschinen AG, Offenbach, Germany

[21] Appl. No.: 116,890

[22] Filed: Aug. 3, 1993

[30] Foreign Application Priority Data

Aug. 5, 1992 [DE] Germany ..... 42 25 810.3

[51] Int. Cl.[6] ..... B68H 45/16

[52] U.S. Cl. ..... 493/424; 493/429; 493/431; 277/30

[58] Field of Search ..... 277/30; 493/425, 493/426, 427, 428, 429, 430, 431, 432, 469, 471

[56] References Cited

U.S. PATENT DOCUMENTS

| | | | |
|---|---|---|---|
| 2,659,437 | 11/1953 | Huck . | |
| 3,657,998 | 4/1972 | Yoritomi | 277/30 |
| 4,038,908 | 8/1977 | Kauffman | 493/468 |
| 4,820,249 | 4/1989 | Wech | 493/471 |

FOREIGN PATENT DOCUMENTS

| | | | |
|---|---|---|---|
| 0084596 | 8/1983 | European Pat. Off. | 277/30 |
| 240173A1 | 11/1994 | Germany . | |
| 0870817 | 10/1981 | U.S.S.R. | 277/30 |

*Primary Examiner*—Bruce M. Kisliuk
*Assistant Examiner*—Christopher W. Day
*Attorney, Agent, or Firm*—Cohen, Pontani, Lieberman, Pavane

[57] ABSTRACT

A reliable, wear-resistant sealing for a collecting and folding cylinder includes, on each folding blade shaft, a disk (4) which has a sealing ring (13) arranged on the collar of the side facing the oil space (6) of the folding cylinder (1). The disk (4) can be pressed by means of a clamping ring (5) arranged on the folding blade shaft (2) against a covering disk (3) eccentrically arranged on the shaft (2). The disks (3, 4) are rotatably connected with one another via a bearing (11) and a stud (12). An additional sealing ring (17) is provided at the collar of the side of the covering disk 3 facing the oil space (6).

11 Claims, 3 Drawing Sheets

SEALING FOR A FOLDIN BALDE SHAFT

FIELD OF THE INVENTION

The invention relates-to a sealing assembly of the end face of a folding blade shaft arranged in a folding blade cylinder.

BACKGROUND AND SUMMARY OF THE INVENTION

A collecting and folding cylinder is part of a folding apparatus. Three folding blade shafts, for example, are arranged on the collecting and folding cylinder. The folding blade shafts rotate around pivoting points which are distributed symmetrically over the cross section of the collecting and folding cylinder. Whereas the collecting and folding cylinder rotates around its center, the folding blade shafts rotate around their respective pivoting points as well. In so doing, they execute a hypocycloidal movement. Moreover, each folding blade shaft executes an oscillating movement which causes the folding blades arranged on it to project partially out of the folding blade cylinder in order to fold the sheets to be folded or to sink into the folding blade cylinder again. Because of this complicated sequence of movements it is necessary to arrange specially made sealing devices at the end face of the collecting and folding cylinder which prevent oil from escaping from an oil space in the interior of the collecting and folding cylinder at the sides of the front boundary of the folding blade shafts or to prevent dirt from penetrating into the interior of the folding blade cylinder.

A known solution to this problem consists in the arrangement of disk-shaped plastic rings of different diameters. The plastic rings execute a sliding and rotating movement relative to one another, which results in a heating of the plastic rings particularly at high folding speeds. As a result, they are deformed in a plastic manner and spring out of their guides. They wear out quickly and can tall into the interior of the folding blade cylinder and cause damage there. Moreover, oil escapes at the sides of the folding blade shafts. It is an object of the present invention to provide a reliable and wear-resistant sealing for a collecting and folding cylinder.

This object is met by providing an end-face sealing assembly surrounding a folding blade shaft in a folding cylinder, the end-face sealing assembly having a covering disk and an additional disk made from metal. Specifically, there is provided a folding cylinder with an interior oil space and a plurality of folding blade shafts arranged at a distance from one another at its circumference and constructed for executing hypocycloidal movements. Each folding blade shaft carries a disk having a bearing. The disk has a sealing ring arranged on the collar of the side facing the oil space of the folding cylinder and can be pressed against a covering disk by a clamping ring arranged on the folding blade shaft, and wherein the covering disk is arranged eccentrically on the shaft, runs in a bearing race via bearings, and is rotatably connected with the disk via a bearing and a stud.

In an advantageous further development, the folding blade shaft is enclosed by a clamping ring which presses the additional disk against the covering disk. In another advantageous construction the covering disk has a sealing ring on its collar, which sealing ring seals the interior of the folding cylinder relative to the covering disk so as to be tight against oil. This prevents oil from spraying out at high rates of rotation of the folding cylinder. Preferably, a sealing ring is also arranged at the collar of the additional disk to seal the space between the coveting disk and the additional disk. The coveting disk and the additional disk are preferably made from aluminum. The surface of the covering disk facing the additional disk is preferably hardened.

BRIEF DESCRIPTION OF THE DRAWINGS

The invention is described in more detail below with reference to the drawings, in which.

DETAILED DESCRIPTION OF THE PREFERRED EMBODIMENTS

Figure 1:
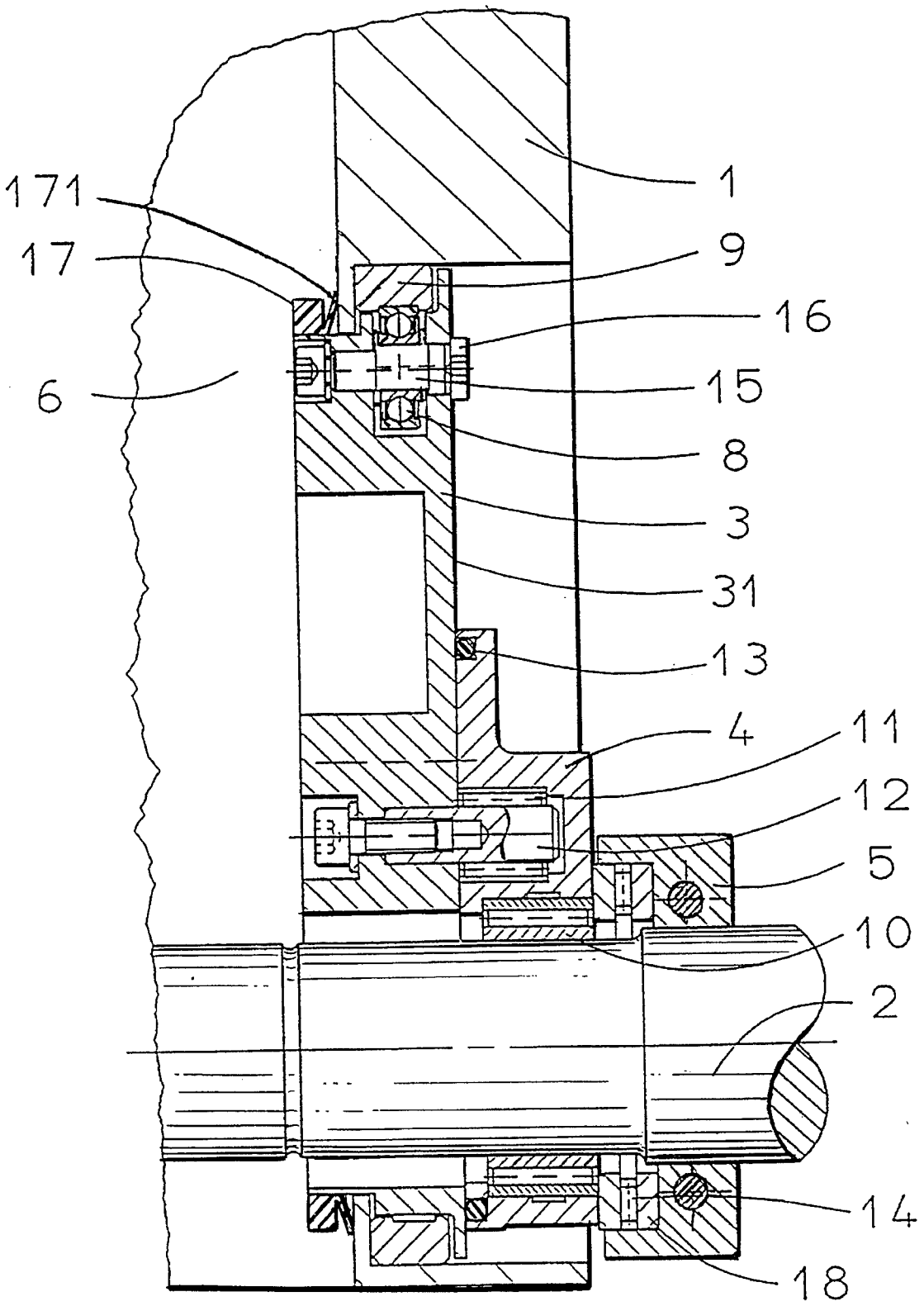
FIG. 1 shows a partial cross-sectional view of a sealing assembly of a folding blade shaft of a folding cylinder.
Figure 2:
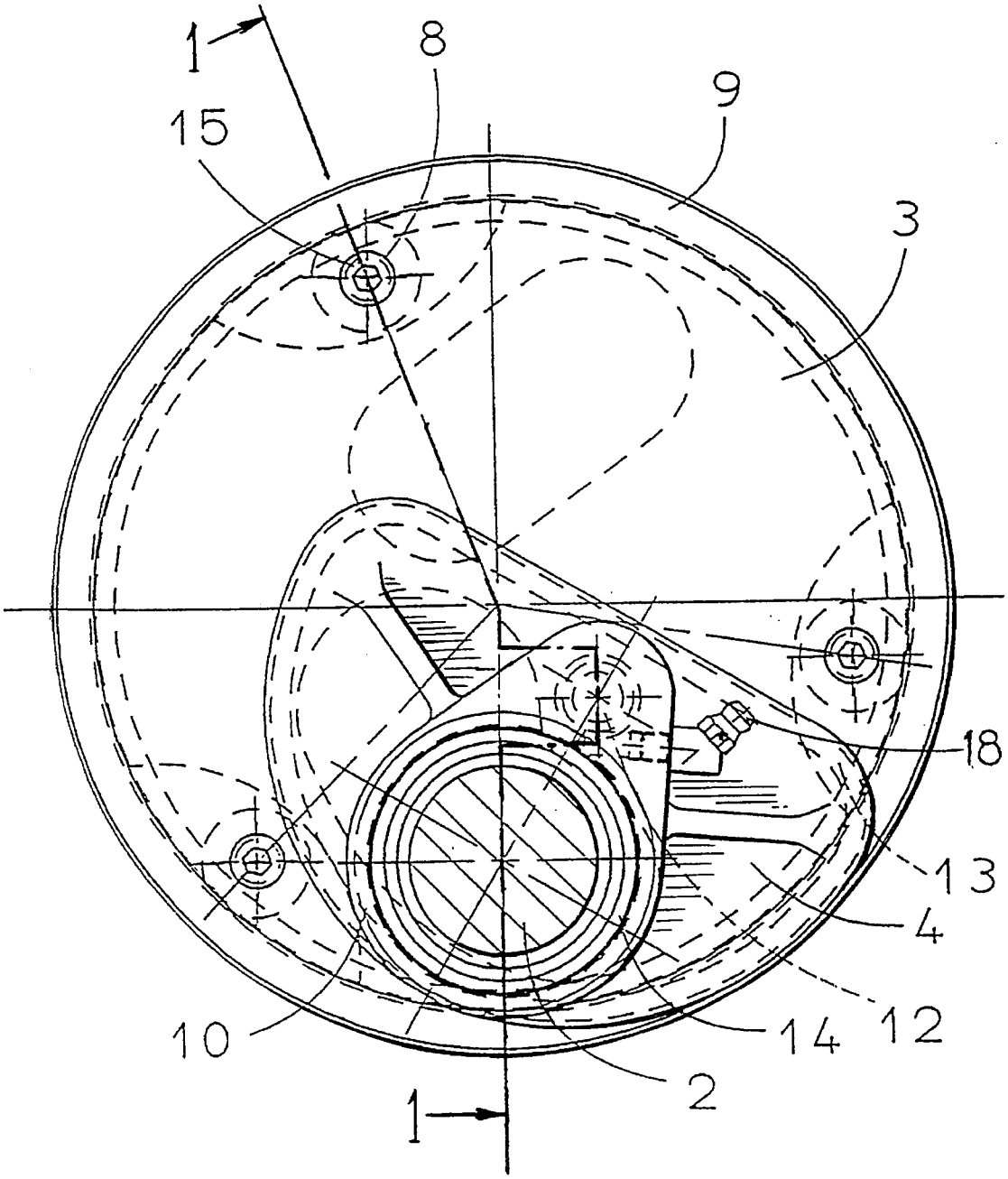
FIG. 2 shows a side view of the folding cylinder with the sealing assembly.
Figure 3:
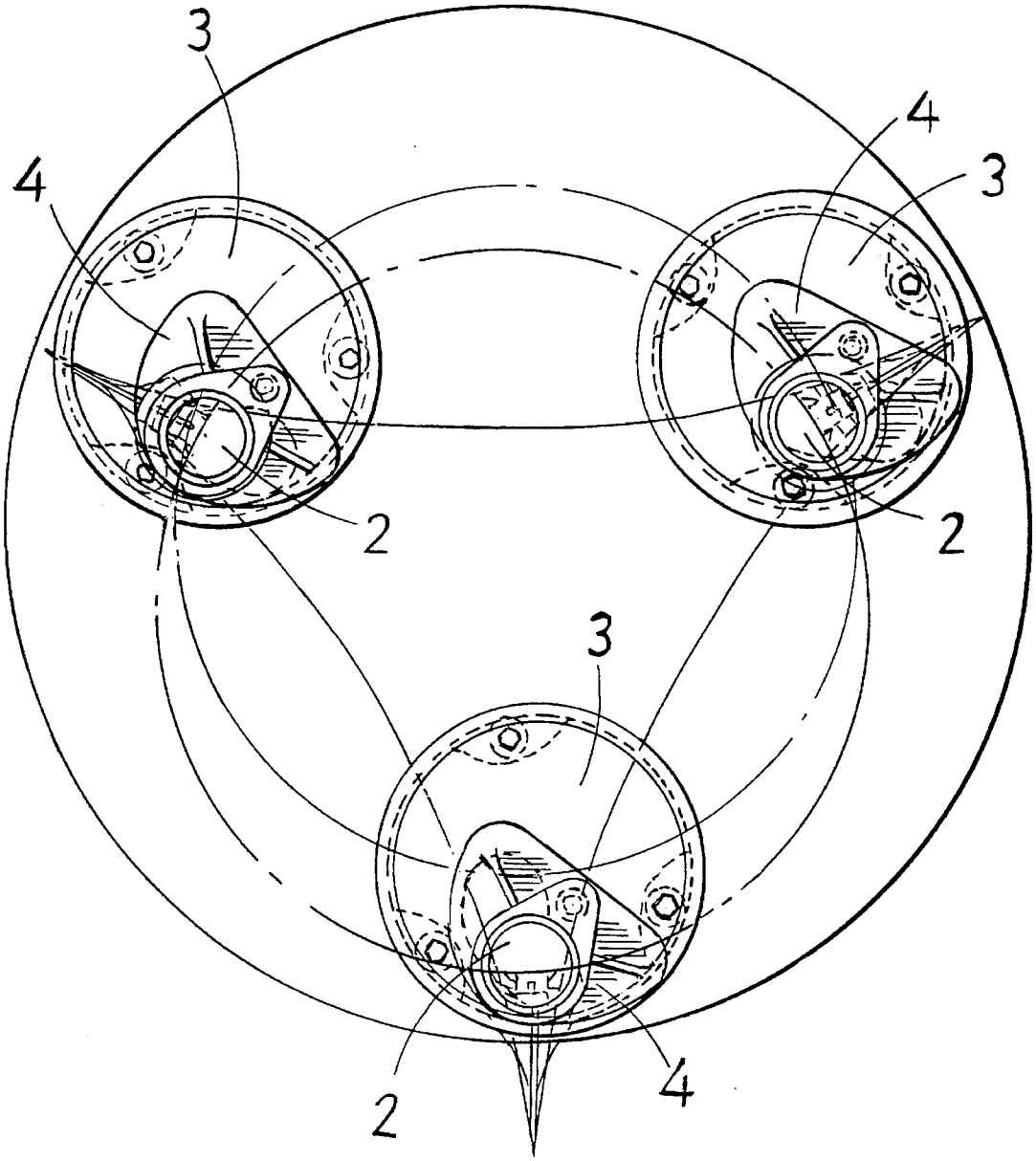
FIG. 3 is a side view of an embodiment of a folding cylinder with three folding blade shafts.

A folding apparatus has e.g. a blade cylinder with three cutting blades and a folding cylinder 1 which is outfitted e.g. with three folding blade shafts 2 as shown in FIG. 3 and known in the art. The folding blade shafts 2 are arranged non-centrically and so as to be symmetrical relative to one another along the cross section of the folding cylinder 1. They penetrate the folding cylinder 1 and are sealed at one of their end faces relative to an oil space 6 in the interior of the folding cylinder 1 by means of a covering disk 3, an oscillating disk 4 and a clamping ring 5. The covering disk 3 and the oscillating disk 4 are made of metal, preferably aluminum. A surface 3 1 of the covering disk 3 is preferably hardened. It is supported radially in a hardened steel bearing race 9 by three grooved ball bearings 8 (compare FIG. 2).

The oscillating disk 4 is held by the folding blade shaft 2 via a rolling beating constructed as a needle bearing 10. It is connected with the covering disk 3 via another rolling bearing, a needle bearing 11, and a hardened stud 12. The stud 12 is secured by a hexagon screw against rotation relative to the covering disk 3. A sealing ring 13 is arranged between the covering disk 3 and a collar of the disk 4. In order to impart sufficient contact pressure force to the sealing ring 13, the disk 4 is pretensioned against the covering disk 3 in the direction of the longitudinal axis of the folding blade shaft 2 by means of the clamping ring 5 and an axial bearing 14. In order to fix the covering disk 3 radially in the beating race 9, the grooved ball bearings 8 are held by eccentric pins 15. Each eccentric pin 15 is secured against rotation by hexagon nuts 16.

The covering disk 3 is sealed by a sealing ring 17 to prevent oil from escaping from the oil space 6. The sealing ring 17 has a lip 171 which presses against the end wall of the folding cylinder 1.

A lubricating nipple (18) (FIG. 2) is provided so that the axial bearing 14 can be lubricated.

The sealing is thus effected via two disks 3 and 4 which are supported via rolling bearings and connected with one another via a pivoting point 12. The folding blade shaft 2 which rotates hypocycloidally causes a rotating and oscillating movement of the disks 3, 4. The sealing relative to the oil space 6 is achieved by an internal sealing ring 17 and by a sealing ring 13 arranged at the outside of the covering disk 3. Existing installations can easily be retrofitted due to the simple construction.

It should be understood that the preferred embodiments and examples described are for illustrative purposes only and are not to be construed as limiting the scope of the present invention which is properly delineated only in the appended claims.

What is claimed is:

1. An end-face sealing assembly for sealing the end-face surrounding a folding blade shaft to a folding cylinder, comprising: a metal covering disk (3) rotatably attached on the folding blade shaft.

2. The end-face sealing assembly according to claim 1, additionally comprising a clamping ring (5) rotatably attached to the folding blade shaft for pressing the additional disk against the covering disk (3).

3. The end-face sealing assembly according to claim 1, wherein the folding cylinder has an interior oil space and additionally comprising a sealing ring (17) on the covering disk (3) for sealing the interior oil space (6) [in the interior] of the folding cylinder (1) at its end-face so as to prevent leakage of oil therefrom.

4. The end-face sealing assembly according to claim 1, additionally comprising a sealing ring (13) arranged between the covering disk (3) and the additional disk (4).

5. The end-face sealing assembly according to claim 1, wherein the covering disk (3) and the additional disk (4) are made from aluminum.

6. The end-face sealing assembly according to claim 5, additionally comprising a hardened surface (31) on the covering disk facing the additional disk (4).

7. A folding cylinder having an interior oil space and a center axis, comprising:

a plurality of folding blade shafts (2) circumferentially arranged about the folding cylinder and including means for executing a hypocycloidal movement, each of the folding blade shafts having a center axis;

a plurality of disks (4), each of the folding blade shafts carrying one of said disks (4), each said disk (4) having a center axis, a collar and comprising a bearing (10) surrounding an associated folding blade shaft (2) and a sealing ring (13) at said collar facing the oil space (6) of the folding cylinder;

a plurality of covering disks, each one of the covering disks being eccentrically and rotatably attached to a respective one of the folding blade shafts (2) so as to be eccentric to the center axes of the folding blade shaft and the folding cylinder;

means (5) arranged on each folding blade shaft (2) for pressing the disk (4) against the covering disk (3);

each said covering disk (3) comprising a first means for rotatably mounting said covering disk (3) to said folding cylinder; and a second means for rotatably mounting said disk (4) on said covering disk (3).

8. The following cylinder according to claim 7, additionally comprising a sealing ring (17) arranged at a side of the covering disk (3) facing the oil space (6).

9. The folding cylinder according to claim 7, wherein said means for pressing the disk (4) against the covering disk (3) comprises a clamping ring (5) arranged on the folding blade shaft (2).

10. The folding cylinder according to claim 7, wherein said first means for mounting said coveting disk (3) on said folding cylinder comprises a bearing race (9) connected to the folding cylinder and a first bearing (8) for rotatably disposing said coveting disk (3) within said bearing race (9).

11. The folding cylinder according to claim 7, wherein said second means for rotatably mounting said disk (4) on said coveting disk (3) comprises a second bearing (11) disposed within said disk (4) and a stud (12) arranged within said bearing.

* * * * *

UNITED STATES PATENT AND TRADEMARK OFFICE
CERTIFICATE OF CORRECTION

PATENT NO. : 5,468,209

DATED : November 21, 1995

INVENTOR(S) : Ulrich Rohrhiursch and Georg Schmid

It is certified that error appears in the above-identified patent and that said Letters Patent is hereby corrected as shown below:

ON THE TITLE PAGE,

On item [54], replace "SEALING FOR A FOLDIN BALDE SHAFT" with

--SEALING FOR A FOLDING BLADE SHAFT--

On item [75], replace "Ulrich Rohrhiursch" with
--Ulrich Rohrhirsch--

Signed and Sealed this

Sixteenth Day of April, 1996

Bruce Lehman

*Attest:*

BRUCE LEHMAN

*Attesting Officer*

*Commissioner of Patents and Trademarks*